United States Patent [19]

Sunada

[11] Patent Number: 4,522,766

[45] Date of Patent: Jun. 11, 1985

[54] GAS-LIQUID CONTACTING DEVICE

[76] Inventor: Satoshi Sunada, 11-8, Minami Ohashi 1-chome, Minami-ku, City of Fukuoka, Fukuoka Prefecture, Japan

[21] Appl. No.: 441,623

[22] Filed: Nov. 15, 1982

[30] Foreign Application Priority Data

Nov. 20, 1981 [JP] Japan ..... 56-187417

[51] Int. Cl.[3] ..... B01F 3/04

[52] U.S. Cl. ..... 261/91

[58] Field of Search ..... 261/91

[56] References Cited

U.S. PATENT DOCUMENTS

| | | | |
|---|---|---|---|
| 1,835,559 | 12/1931 | Cutler | 261/91 |
| 1,853,853 | 4/1932 | Fleisher | 261/91 |
| 1,859,770 | 5/1932 | Fleischer . | |
| 2,631,830 | 3/1953 | Carraway | 261/91 |
| 2,771,283 | 11/1956 | Eranosian | 261/91 |
| 2,796,241 | 6/1957 | Lhota | 261/91 |
| 2,962,835 | 12/1960 | Clark | 261/91 |
| 3,235,233 | 2/1966 | Bolton | 261/91 |
| 3,421,745 | 1/1969 | Prupis | 261/91 |
| 3,444,669 | 5/1969 | Panzica et al. . | |
| 3,904,714 | 9/1975 | Rooney et al. | 261/91 |
| 4,270,506 | 6/1981 | Lowe | 261/91 |

FOREIGN PATENT DOCUMENTS

| | | | |
|---|---|---|---|
| 69139 | 6/1915 | Austria | 261/91 |
| 1907646 | 9/1970 | Fed. Rep. of Germany | 261/91 |
| 17344 | 2/1976 | Japan . | |
| 457849 | 4/1975 | U.S.S.R. | 261/91 |

OTHER PUBLICATIONS

K. Aida–"Sanitary Engineering Handbook", p. 19, (translation), Oct. 31, 1967–Asakura Book Store, Japan. Dictionary of Water Supply and Drainage Machinery and Materials, Oct. 1, 1976, by Industrial Investigation Assoc., Japan, Drawing on p. 2–55.

*Primary Examiner*—Tim Miles

*Attorney, Agent, or Firm*—LeBlanc, Nolan, Shur & Nies

[57] ABSTRACT

A gas-liquid contacting device is disclosed which comprises a frame, a driving means mounted to the frame, a vertical rotating shaft rotatably mounted to the frame and adapted to be driven by the driving means, and a rotor secured to the lower end of the vertical rotating shaft, the rotor being substantially a hollow body of rotation e.g. a hollow inverted cone with a center line coaxial to the axis of the rotating shaft. The rotor is adapted to be immersed partly or entirely into the liquid to be mixed with a gas, e.g. air.

4 Claims, 12 Drawing Figures

GAS-LIQUID CONTACTING DEVICE

BACKGROUND OF THE INVENTION

The present invention relates to a gas-liquid contacting device and more particularly to a gas-liquid contacting device for use in dust collection apparatuses, aeration apparatuses, cooling apparatuses, and the like.

Hitherto it has been a common practice that in a dust collection, aeration, or cooling apparatus or the like, cold water, high temperature cooling water, or the like is sucked from the apparatus by a pump(s) separately arranged therefrom and delivered under pressure to injection nozzles of the apparatus so that the water, etc. is sprayed into the atmosphere to produce gas-liquid contact.

With such an arrangement, simplification of the apparatus is hard to realize. On the other hand, a mechanical aeration apparatus, etc., which operates to scatter accumulated water by a number of rotary blades provided on a rotor to effect a gas-liquid contact, requires a complicated constitution and requires a great deal of power.

SUMMARY OF THE INVENTION

It is a principal object of the present invention to provide a gas-liquid contacting device which can discard all of the defects or difficulties inherent to the conventional apparatus as described above.

It is another object of the present invention to provide a gas-liquid contacting device which can scatter the liquid in the form of a body of rotation comprising substantially a continuous thin liquid film or fine liquid particles.

It is a further object of the present invention to provide a gas-liquid contacting device which carries out gas-liquid contact quite smoothly and easily.

It is a still further object of the present invention to provide a gas-liquid contacting device which is compact in constitution and requires less power to be driven.

In accordance with the present invention a gas-liquid contacting device is provided which comprises a frame, a vertical shaft rotatably mounted on the frame, a driving means mounted to the frame so as to drive the vertical shaft, and a rotor secured to the vertical shaft at its lower end and having substantially the form of an inverted hollow cone with an axis coaxial to the rotating shaft, whereby the rotor is adapted to be immersed partially or entirely into the liquid so that the liquid is drawn upwards along the sides of the rotor by centrifugal force under a constraining force due to adhesion of the liquid to the sides of the rotor, resulting in the spreading from the upper edge of the cone in substantially the form of a thin liquid film or fine liquid particles.

BRIEF DESCRIPTION OF THE DRAWINGS

These and other objects of the present invention will become more readily apparent upon reading the following specification and upon reference to the accompanying drawings, in which.

DESCRIPTION OF THE PREFERRED EMBODIMENTS

Figure 1:
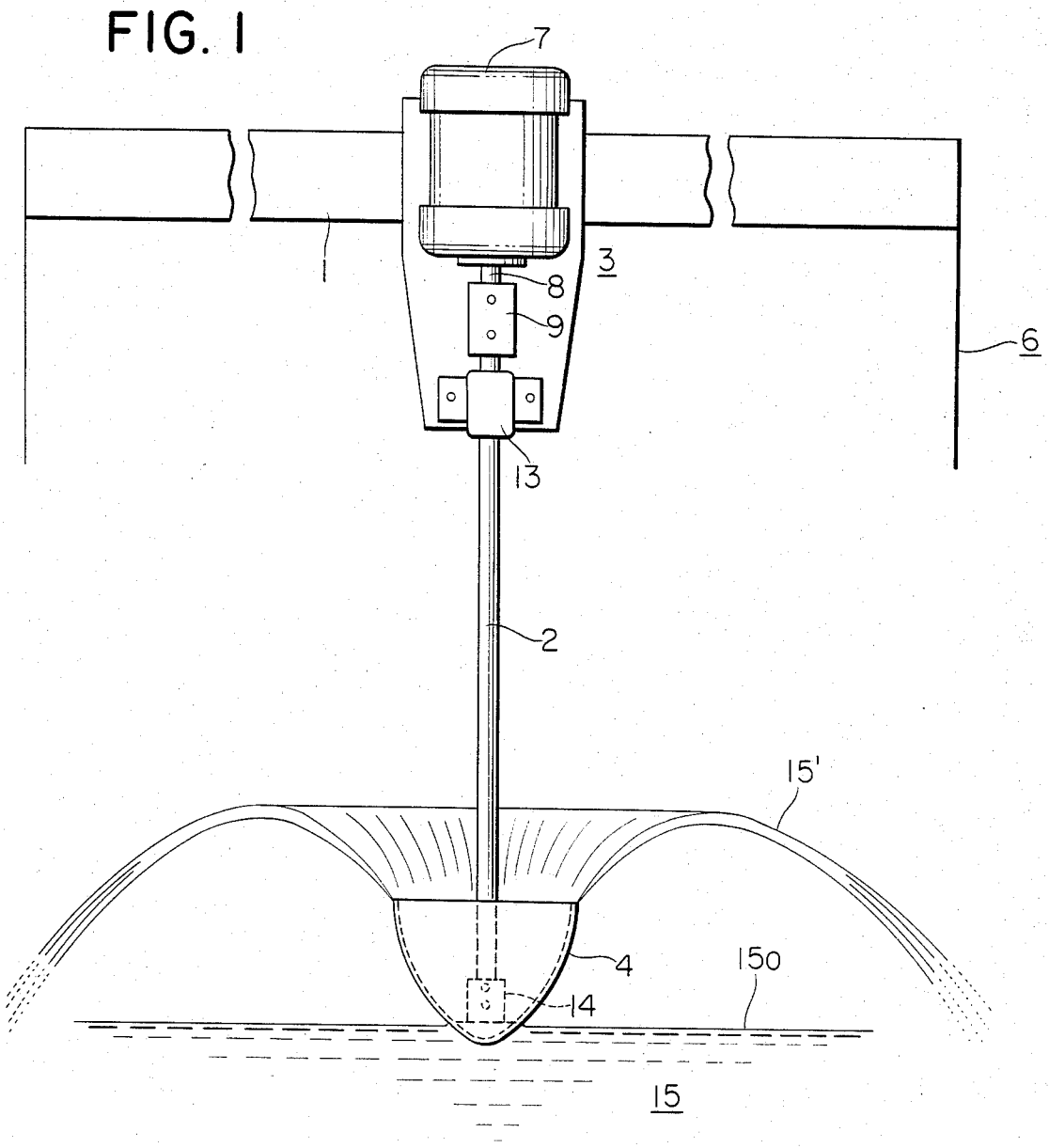
FIG. 1 is a front elevational view of one embodiment of the present invention.

Referring now to FIG. 1 of the attached drawings, a vertical rotating shaft 2 with its upper part rotatably connected to a driving device 3 which is mounted to a frame 1 that is in turn installed on the upper part of a water vessel 6, etc. constituting part of a dust accumulating apparatus, for example. As shown in FIG. 1 driving device 3 comprises merely an electric motor 7, the output shaft of which is drivingly connected to the upper portion of rotating shaft 2 through a coupling 9. Alternatively, as shown in FIG. 6 rotating shaft 2 may be provided at its upper end portion with a pulley 10 which is adapted to be driven by an electric motor 7 through a belt 11 which is reeved about a pulley 12 secured to the output shaft 8 of motor 7, motor 7 being mounted to frame 1.

Figure 2:
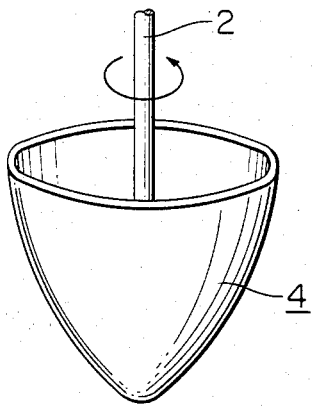
FIG. 2 is a perspective view to show the inverted conical shaped rotor shown in FIG. 1.
Figure 3:
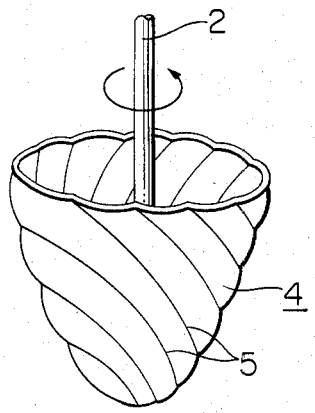
FIGS. 3 to 5 are perspective views to show various modified embodiments of the rotor shown in FIG. 2.
Figure 6:
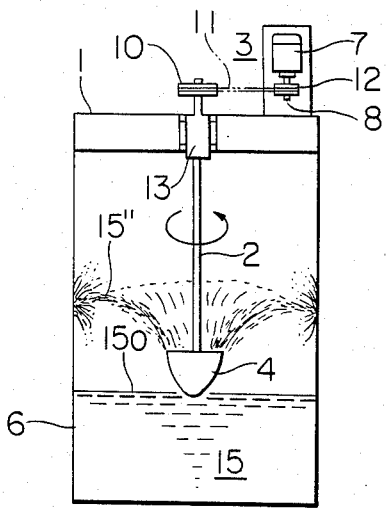
FIGS. 6 and 7 are diagrammatical views to show the operation of the embodiment shown in FIG. 1 in two different modes.

As shown in FIGS. 1 and 6, fixedly secured to the lower end of rotating shaft 2 is a rotor 4 in the form of a hollow body of rotation which has a center axis coaxial with the axis of rotating shaft 2. Preferably rotor 4 has substantially the form of a hollow inverted cone with an open upper end as shown in FIGS. 1 and 2. The outer periphery of rotor 4 may be smooth as shown in FIG. 2, or it may be formed, as shown in FIGS. 3, with a number of equally spaced spiral grooves 5 starting from the lower end which spread upwards. In FIG. 1 the reference numeral 13 indicates a bearing provided in driving device 3 to rotatably support rotating shaft 2 at its upper portion, and 14 is a boss formed within rotor 4 at its bottom for securing the lower end of rotating shaft 2.

Figure 4:
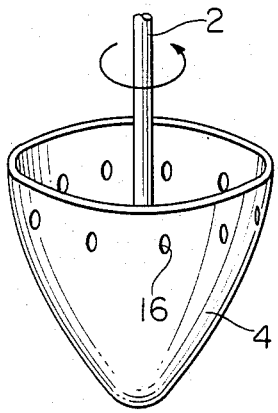

Further, the wall of rotor 4 may be provided with a number of through holes 16 at its upper part on a circle as shown in FIG. 4 with the object of mixing the liquid with gas, e.g. air.

Now the operation of the present invention will be explained.

Figure 7:
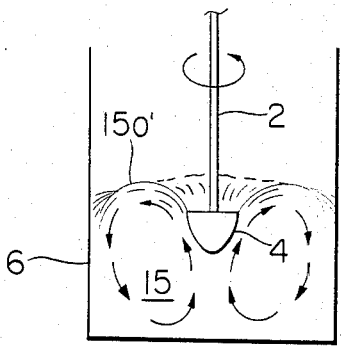

Upon rotation of motor 7, rotor 4 is rotated through vertical rotating shaft in the direction shown by the arrow. In this case, as shown in FIG. 1, if the lower part of rotor 4 is slightly immersed into a liquid 15, penetrating its surface 15, the liquid which adheres to the outer periphery of rotor 4, it is projected outwards in a substantially continuous thin liquid film to be spread in the form of a film comprising fine particles as shown in FIG. 6 by 15″. If rotor 4 is entirely immersed into liquid 15 so that its outer periphery is completely surrounded by liquid 15 as shown in FIG. 7, there are caused flows of liquid within liquid 15 as shown by the arrows. Not only is the surface area of the liquid 15 increased by the action, but liquid near the bottom of the container is drawn to the surface to be contacted with the atmosphere.

Figure 8:
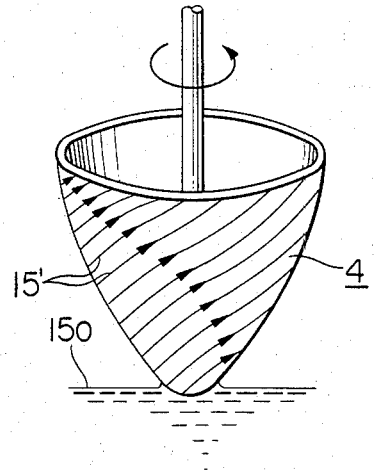
FIG. 8 is a perspective view to show the flow paths of the liquid on the outer periphery of the rotor shown in FIG. 2.

FIG. 8 indicates schematically the flow paths 15′ of the liquid on the outer periphery of rotor 4, which are forward-curved, namely, twisting in the same direction as the direction of rotation of rotor 4 when rotor 4 is partially immersed into liquid 15, when viewed from a stationary reference frame. On the other hand, the flow paths relative to the rotating rotor 4 are backward-curved, namely, twisting in the direction opposite to the direction of rotation of rotor 4.

The spiral grooves shown in FIG. 3 are backward-curved. Spiral grooves can damp the turbulence of the flow, and stabilize the relative flow paths on the outer periphery of rotor 4, and can also increase the flow rate of the liquid which is moved up by rotor 4.

Figure 5:
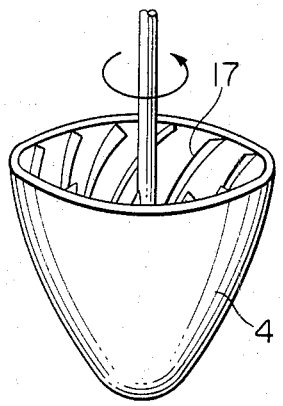

The rotor 4 shown in FIG. 5 is provided with a number of curved vanes 17 on its inner periphery. When rotor 4 is rotating with its lower end portion partly immersed into the liquid as shown in FIG. 1, the air within rotor 4 is discharged outwards from the upper edge thereof by curved vanes 17 uniformly, promoting the contact of the air with the liquid moving up on the outer periphery of rotor 4.

Figure 11:
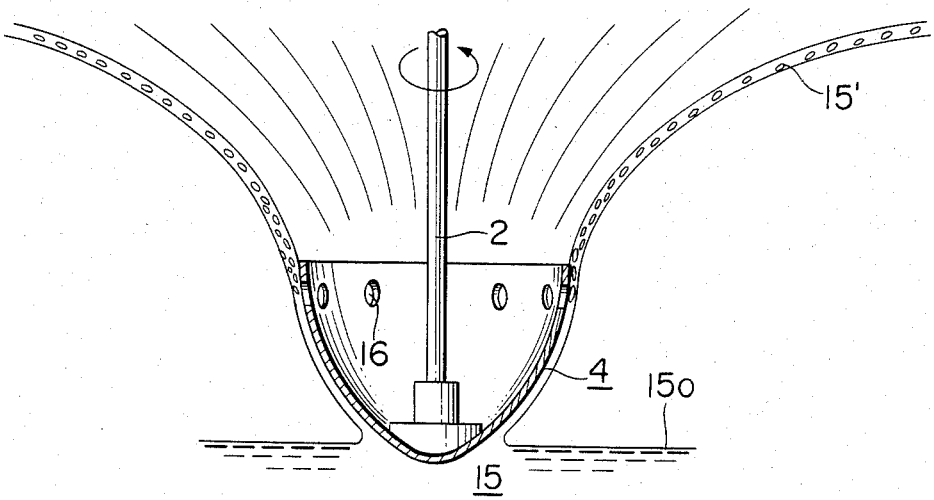
FIG. 11 is a partial sectional view on a larger scale, schematically illustrating the condition of mixing of the air passing through the holes formed in the wall of the rotor shown in FIG. 4 with the liquid moving upwards on its outer periphery when the rotor is rotating with its lower portion being partially immersed into the liquid.
Figure 12:
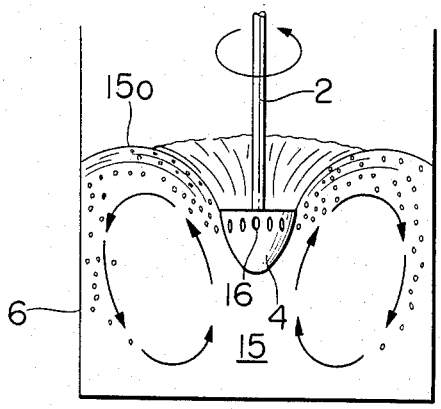
FIG. 12 is a view similar to FIG. 7 schematically illustrating the state of the agitation of the liquid when the rotor shown in FIG. 4 is rotating with the rotor entirely immersed into the liquid.

Further, the mixing of the liquid spread from the upper edge of rotor 4 with a gas, e.g. air can be promoted if the rotor 4 shown in FIG. 4 is used, in which the wall of rotor 4 is provided with a number of through holes 16, because, as shown in FIG. 11, the air passing through holes 16 to the outside of rotor 4 is forced to be mixed into the liquid moving upwards along the outer periphery of rotor 4 as bubbles, and if rotor 4 is entirely immersed into liquid 15 as shown in FIG. 12, the air passing through holes 16 is spread into the liquid as bubbles, stirring it.

Figure 9:
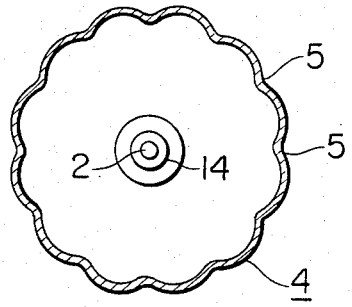
FIG. 9 is a horizontal cross-section of the rotor shown in FIG. 3.
Figure 10:
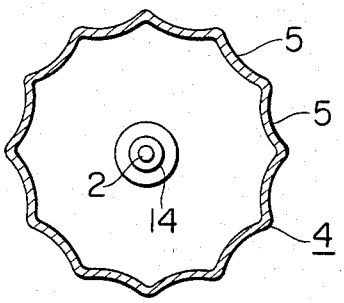
FIG. 10 is a horizontal cross-section similar to FIG. 9, but having a shape somewhat different from that of FIGS. 3 and 10.

Although rotor 4 shown in FIG. 3 has a cross-section as shown in FIG. 9 such that spiral grooves 5 are formed between outwardly protruded arcuate faces, it may instead have a cross-section as shown in FIG. 10 such that arcuate spiral faces 5 are protruded inwards on the outer periphery of rotor 4. Note, that in both of FIGS. 9 and 10, the cross-section contours of the outwardly protruding spiral faces between the grooves have a smooth curved contour. There are no differences in the formation of the liquid film during the rotation of rotor 4 as well as the spreading condition of the fine liquid particles at the time of an increase of r.p.m. of rotor 4 between the rotors having the cross-sections shown in FIGS. 9 and 10. The grooves resulting from the configurations shown in FIGS. 9 and 10 are relatively shallow and as shown in FIG. 3 provide a substantial angle relative to the vertical axis of the rotor. Note, in FIG. 3, such spiral angle is in the order of 45 degrees.

From the foregoing, it will be appreciated that in accordance with the present invention a rotor 4 having a quite simple outer configuration of a hollow inverted cone can produce substantially a continuous splash in the form of a thin liquid film or fine liquid particles when the rotor is rotated with its lower part being either partly dipped or totally immersed into the liquid, without the need of provision of rotary vanes, etc. on its periphery, resulting from the rise of the liquid on the outer periphery of the rotor adhering thereto under the action of the centrifugal force applied to the liquid. Therefore, the gas-liquid contacting device according to the present invention can be advantageously used in dust collecting, aeration, or cooling apparatuses, etc. since the gas-liquid contacting can take place quite smoothly and easily. Further the power required for the device of the present invention can be small, since the resistance encountered by the rotor in the liquid is small, and thus the device can be made compact.

Although the invention has been shown in connection with several specific embodiments, it will be readily apparent to those skilled in the art that various changes in form and arrangement of parts may be made to suit requirements without departing from the spirit and scope of the invention.

What is claimed is:

1. A gas liquid contacting device comprising a frame, a driving means mounted to said frame, a vertical rotating shaft rotatably mounted to said frame and adapted to be driven by said driving means, and a rotor adapted to be rotated by said vertical rotating shaft, said rotor being substantially a body of rotation the axis of which coincides with that of said vertical rotating shaft, said rotor being adapted to be partially or entirely immersed into said liquid to splash the liquid in the form of a substantially continuous thin film or fine particles; said rotor having substantially the shape of an inverted cone, and being formed on its outer periphery with a number of equally spaced spiral grooves which spiral backward relative to the direction of rotation from the lower end towards the upper end, of the rotor with a relatively large angle relative to the vertical axis of the rotor whereby a corresponding number of outwardly protruding spiral surfaces are formed between adjoining spiral grooves, said outwardly protruding spiral surfaces having a smoothly curved cross section contour between said grooves to avoid sharp edges on surfaces between said grooves.

2. A gas-liquid contacting device as claimed in claim 1 wherein said cone is hollow with the top end being open and constituting the termination edge of the rotor enabling unrestricted passage of liquid off of the exterior of said rotor.

3. A gas-liquid contacting device as claimed in claim 2 wherein said rotor is fixedly secured at its inner end to said vertical rotor shaft at its lower end.

4. A gas-liquid contacting device as claimed in claim 2 wherein said hollow cone is formed on its inner periphery with a number of equally spaced curved vanes.

* * * * *